US005111248A

United States Patent [19]

Kita et al.

[11] Patent Number: 5,111,248

[45] Date of Patent: May 5, 1992

[54] PRINTING APPARATUS

[75] Inventors: Masahiro Kita, Itabashi; Ikuo Negoro, Saitama, both of Japan

[73] Assignee: Asahi Kogaku Kogyo Kabushiki Kaisha, Tokyo, Japan

[21] Appl. No.: 535,667

[22] Filed: Jun. 11, 1990

[30] Foreign Application Priority Data

Jun. 9, 1989 [JP] Japan ..... 1-147072
May 9, 1990 [JP] Japan ..... 2-119179

[51] Int. Cl.[5] ..... G03G 15/20

[52] U.S. Cl. ..... 355/282; 219/216; 355/308

[58] Field of Search ..... 355/282, 200, 285, 295, 355/308; 219/216

[56] References Cited

U.S. PATENT DOCUMENTS

| | | | |
|---|---|---|---|
| 3,977,780 | 8/1976 | Cassano et al. | 355/308 |
| 4,021,108 | 5/1977 | Ozaki et al. . | |
| 4,084,901 | 4/1978 | Aasen . | |
| 4,119,059 | 10/1978 | Moser et al. | 118/653 |
| 4,165,168 | 8/1979 | Baumann et al. . | |
| 4,531,823 | 7/1985 | Deguchi et al. . | |
| 4,640,604 | 2/1987 | Kozuka et al. . | |
| 4,752,801 | 6/1988 | Kando | 355/290 X |
| 4,782,359 | 11/1988 | Tomoe | 219/216 X |
| 4,806,970 | 2/1989 | Nakatomi et al. | 219/216 X |
| 4,884,110 | 11/1989 | Tsurubuchi et al. | 355/319 |
| 4,965,640 | 10/1990 | Watarai et al. | 355/283 |

FOREIGN PATENT DOCUMENTS

| | | | |
|---|---|---|---|
| 58-153976 | 9/1983 | Japan | 355/282 |
| 58-160971 | 9/1983 | Japan | 355/282 |
| 62-260165 | 11/1987 | Japan | 355/282 |
| 63-175879 | 7/1988 | Japan | 355/282 |
| 1-293375 | 11/1989 | Japan | 355/282 |

*Primary Examiner*—R. L. Moses
*Attorney, Agent, or Firm*—Sandler, Greenblum, & Bernstein

[57] ABSTRACT

A printing apparatus employing an electrophotographic system using a continuous recording medium, where an unfixed toner image is transferred onto the recording medium by a transfer unit. A fixing unit for fixing the unfixed toner image onto the recording medium is movably disposed and can be secured at a plurality of positions.

18 Claims, 4 Drawing Sheets

PRINTING APPARATUS

BACKGROUND OF THE INVENTION

The present invention relates to a printer for forming an image on a continuous recording sheet utilizing an electrophotographic system.

There are conventionally known image forming apparatuses utilizing a so-called electrophotographic transfer system, such as an electronic copying machine, in which the surface of a photoconductive drum is exposed to light to form a latent image on the drum surface. Toner is applied to the latent image for development and the developed image is transferred onto a recording sheet and fixed by a fixing unit.

Another such apparatus is the laser beam printer which provides a hard copy of image information by scanning and exposing a charged photoconductive drum, to a laser beams modulated based on image information such as figures, characters and the like, using the copy process of the above mentioned electrophotographic transfer system.

The laser beam printer is very useful, because it can be widely used in such a manner that it draws figures of information received by an image reading unit (image scanner) or used as an output terminal of a facsimile. Further, the laser beam printer outputs information at a high speed.

In general, a conventional laser beam printer comprises an existing electronic copying machine as a base unit and uses a sheet cut to a predetermined size, and a heat roll fixing unit, which includes a pair of fixing rollers with a heat roller heated to a high temperature and a backup roller pressed against the heat roller. An unfixed toner image is transferred onto a recording sheet, and the recording sheet is thereafter caused to pass between the fixing rollers to be heated and pressed, whereby the toner is melted and adheres to the recording sheet.

The electrophotographic system is such that the rotation of a photoconductive drum causes an exposed portion of the drum to reach a transfer unit. A toner image is then transferred onto the recording sheet which is fed at a speed identical with the peripheral speed of the photoconductive drum at the transfer unit. Thus it is impossible to form images by intermittently interrupting the process due to the structure of the process.

Therefore, the laser beam printer is provided with a memory capable of storing at least one page of information. When the one page of information is inputted therein, the printer outputs the information in one lot.

It can be considered, of course, to use this laser beam printer as an output terminal of a computer. In this case, however, it is preferable to use a continuous recording sheet (a fan-fold sheet having feed holes and folded along perforated tear lines enabling the sheet to be simply torn off, hereinafter, referred to as a continuous sheet) which has been used in a conventional line printer. The use of this continuous sheet has many advantages. The output data can be observed sequentially as it is outputted. The data can be easily arranged because it is continuously outputted and a number of pages can be supplied without using a dedicated stacker. The feed of the sheet (control of printing positions) can be correctly and easily adjusted because it is fed by the feed holes, and the like.

When a continuous sheet is used to a laser beam printer using heat roll fixing system, the length of a recording sheet feed path from the transfer unit to the fixing position of a fixing unit must be set to substantially the same distance as the distance between perforated tear lines of a continuous sheet. This prevents the disadvantage that when the laser beam printer stops (for wait or because an operation is completed), a page being subjected to a fixing action is stopped between a pair of fixing rollers and a page of the continuous sheet on which a toner image is in the process of being fixed remains nipped between the pair of the fixing rollers.

More specifically, since the continuous sheet is cut off along the perforated tear lines for use, no image must be formed within a predetermined region in the vicinity of the perforated tear lines. Thus, in a laser beam printer where images are formed for each page, the vicinity of the tear lines is arranged to be stopped in a state that corresponds to the transfer unit. Consequently, when the length of the recording sheet feed path from the transfer unit to the fixing position is set to substantially the same distance as between perforated tear lines of the continuous sheet, the above disadvantage can be avoided, because the vicinity of the tear line where no image is formed is caused to correspond to the position of the fixing unit where the fixing action is effected, when the laser beam printer stops.

As a result, however, a problem arises in that continuous sheets having a different distance between perforated tear lines (i.e., a different length of a page) cannot be interchangeably used in the same laser beam printer. That is, continuous sheets having different intervals between perforated tear lines cannot be used.

SUMMARY OF THE INVENTION

Taking the above into consideration, it is an object of the invention to provide an electrophotographic printer which is interchangeably applicable to continuous sheets having a different distance between perforated tear lines.

For the above object, according to the invention, there is provided a printing apparatus employing an electrophotographic system using a continuous recording sheet, a toner image being transferred onto the continuous recording sheet by a transfer means. The printing apparatus comprises:

means for fixing an unfixed toner image on a continuous recording medium, means for fixing being movably disposed in the apparatus; and means for securing the fixing means at a certain position.

DESCRIPTION OF THE ACCOMPANYING DRAWINGS

DESCRIPTION OF THE EMBODIMENTS

Figure 1:
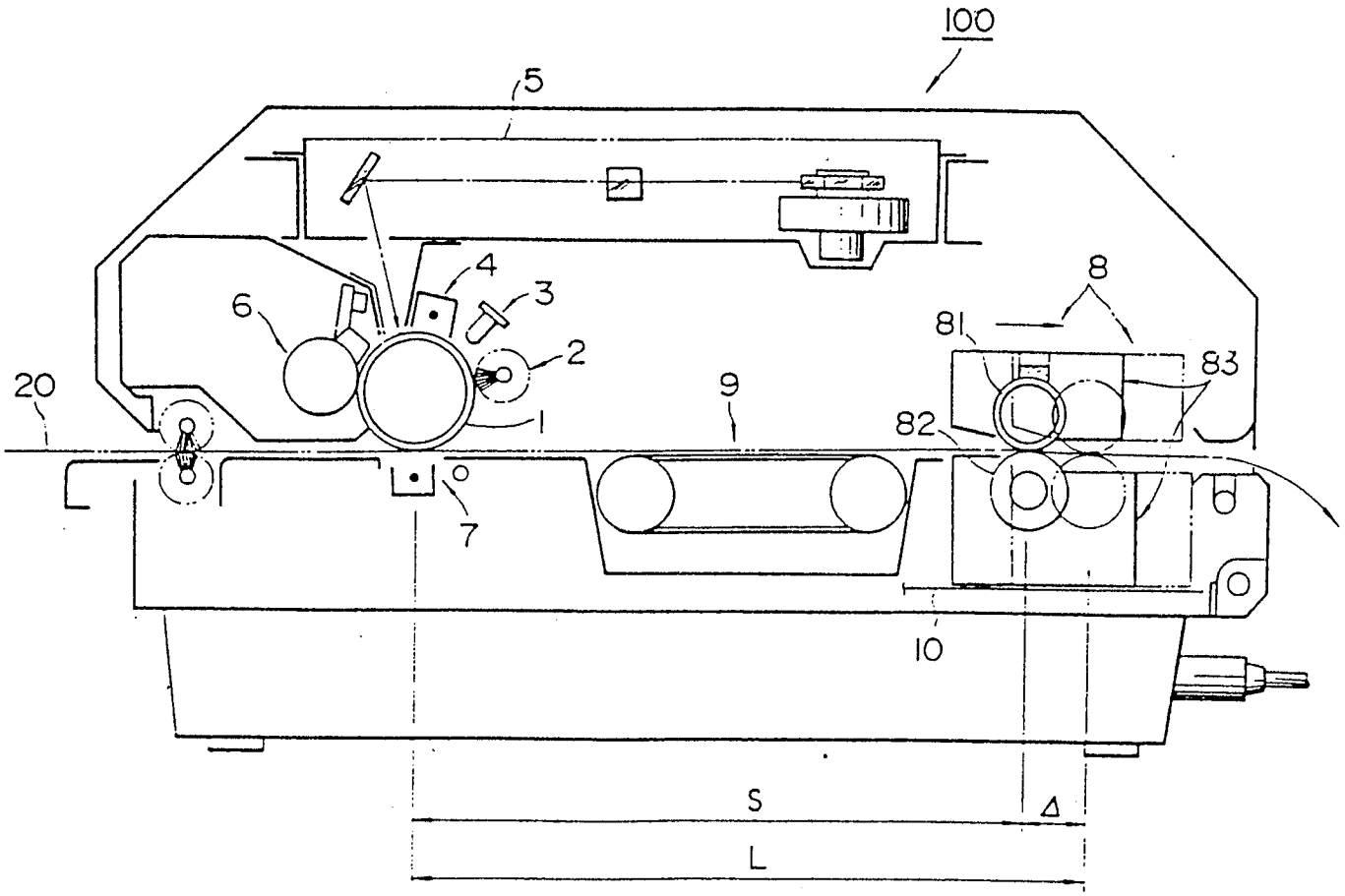
FIG. 1 is a schematic diagram of a laser beam printer using a continuous sheet as an embodiment of the present invention.

FIG. 1 is a schematic diagram of a laser beam printer as an embodiment of the present invention. The laser beam printer 100 forms an image on a continuous sheet 20 as a hard copy corresponding to image or character information received from a computer or the like.

A photoconductive drum 1 is rotated at a predetermined peripheral speed by a main motor which is not shown. A toner cleaning unit 2, a discharging unit 3, a charging unit 4, a scanning optical system 5 for introducing a laser beams onto the photoconductive drum 1, a developing unit 6, and a transfer unit 7 are disposed around the circumference of photoconductive drum 1 in the rotational direction thereof.

A fixing unit 8 is disposed on the right hand side of the photoconductive drum 1 as shown in FIG. 1. A tractor belt 9 is disposed downwardly of the feed path of the continuous sheet 20 between the photoconductive drum 1 and the fixing unit 8 for feeding the continuous sheet 20.

The tractor belt 9 comprises two endless belts disposed in parallel and having projections to engage with the feed holes defined at opposite sides of continuous sheet 20 and is driven by a motor, which is not shown.

The continuous sheet 20 is fed by a heat roller 81 and a backup roller 82 from the left to right as shown in FIG. 1. The tractor belt 9 applies a predetermined amount of tensile force to continuous sheet 20.

Generally, an operation of the laser beam printer 100 is as follows.

The photoconductive drum 1 is charged by the charging unit 4. The laser beam printer 100 effects a main scanning (exposing) on the surface of the photoconductive drum 1 in the axial direction of the drum by a laser beam from the scanning optical system 5. The photoconductive drum 1 rotates (auxiliary scanning), developing a latent image formed on the surface of the photoconductive drum 1 at the developing unit 6 to form a toner image. The toner is transferred onto continuous sheet 20 at transfer unit 7, and the toner image is fixed onto continuous sheet 20 by fixing unit 8, which then ejects continuous sheet 20.

The fixing unit 8 is an independent unit comprising a cylindrical heat roller 81 heated to a predetermined temperature by a heating element such as halogen lamp, and a backup roller 82. The heat roller 81 and the backup roller 82 are arranged in such a manner that they are vertically disposed in confrontation to form a pair of fixing rolls mounted in the frame of fixing unit 8. The upper roller, or heat roller 81, is mechanically connected to and driven by a drive means (not shown) at a circumferential speed substantially similar to the circumferential speed of the photoconductive drum 1. The heat roller 81 carries out the feeding of the continuous sheet as well as the fixing operation.

The fixing unit 8 can be moved along the frame 10 parallel with the feeding direction of the fan-fold sheet 20.

More specifically, the fixing unit 8 can be fixedly disposed at a position by which the length of the continuous sheet 20 feed distance from the transfer unit 7 to the fixing position (the position where the heat roller 81 is in contact with the backup roller 82) of fixing unit 8 is "S", as shown by solid lines in FIG. 1, and also at a position by which the distance is "L", i.e., "S+Δ", as shown by dotted lines in FIG. 1. When the "S" or "L" distances are set to predetermined sizes, substantially similar to the intervals between the perforated tear lines of the continuous sheets 20 desired to be used by the printer, fixing unit 8 is selectively disposed in accordance with the continuous sheet 20 to be used. Thus, a plurality of types of continuous sheets having a different interval between perforated tear lines can be used.

Figure 2:
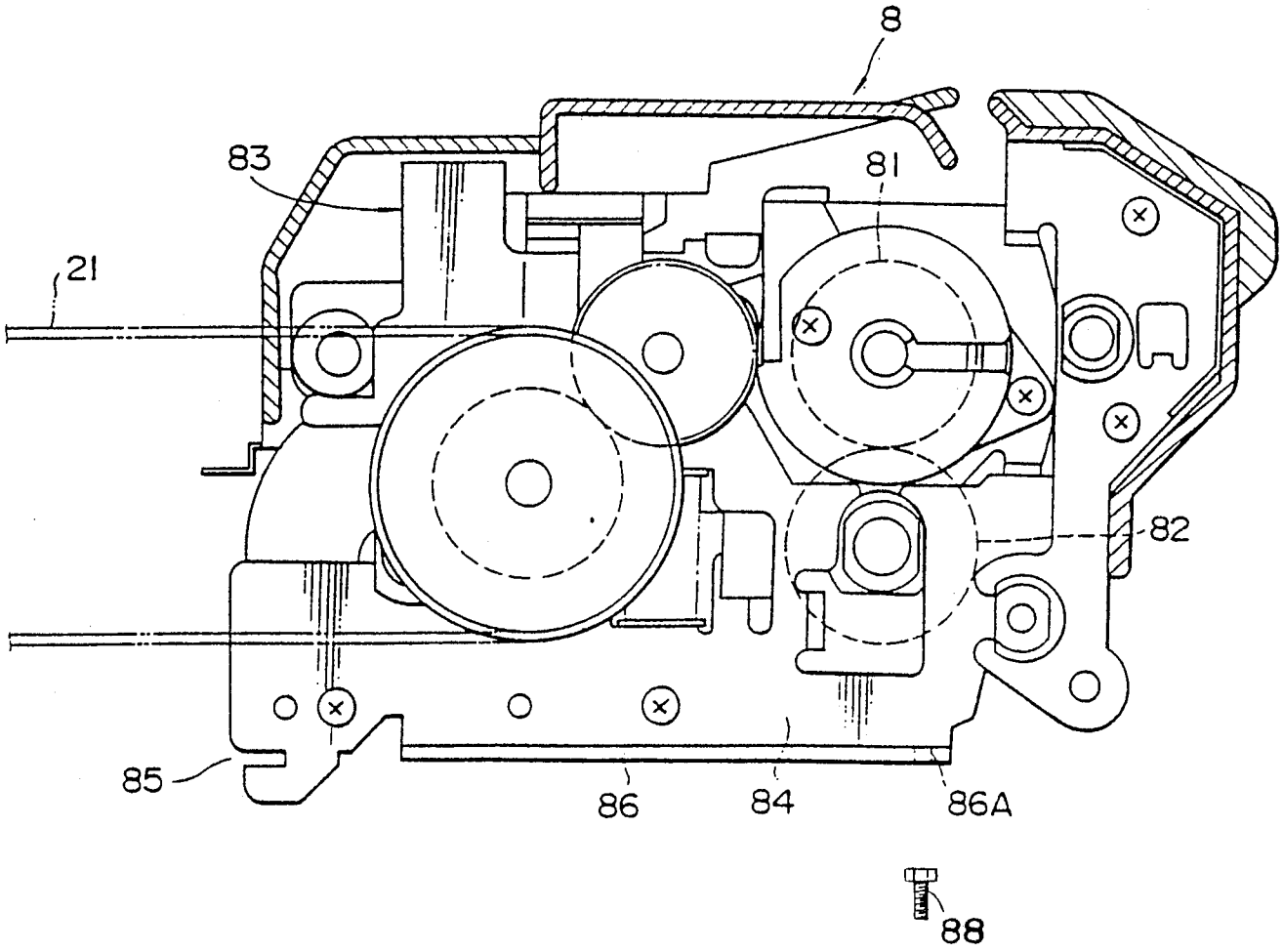
FIG. 2 is an enlarged side view of the fixing unit.
Figure 3:
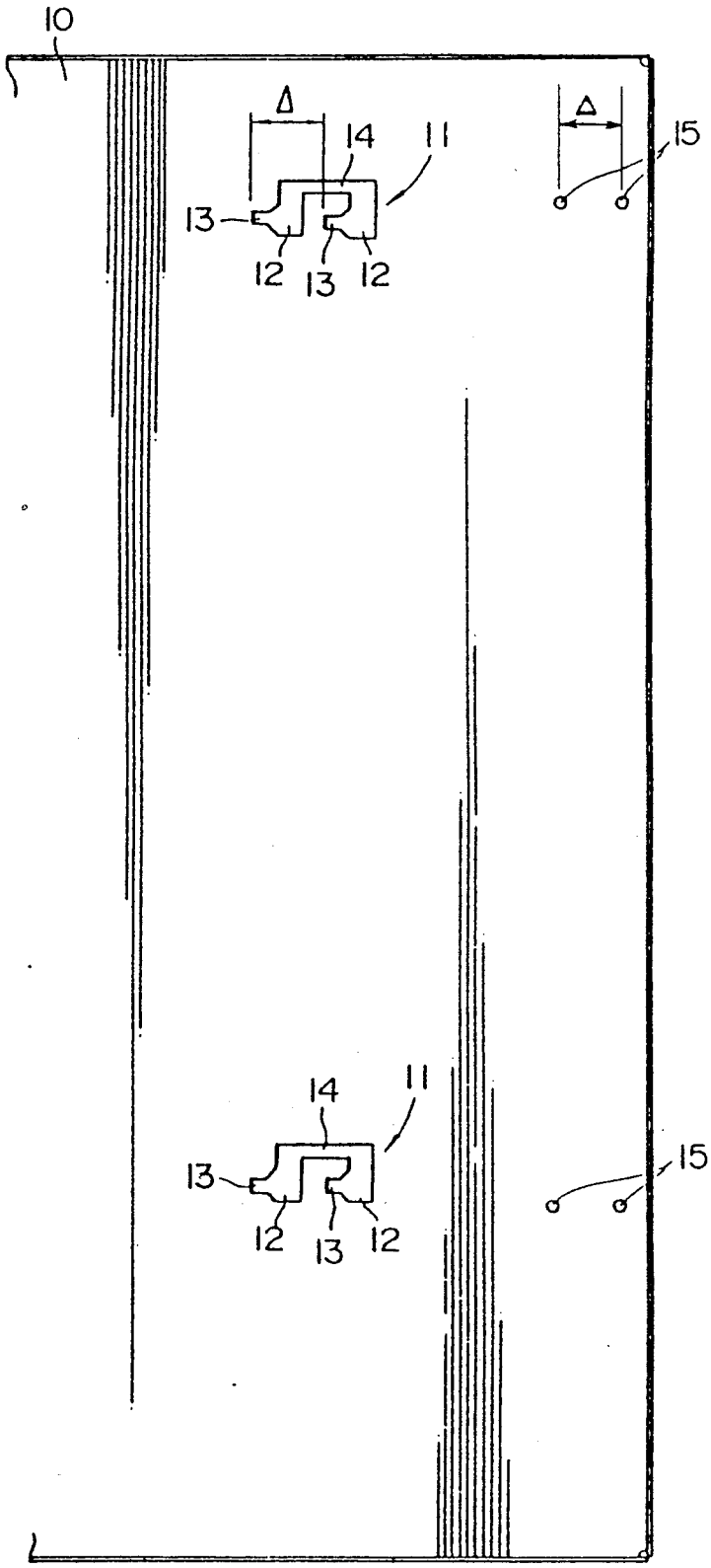
FIG. 3 shows a partial plan view of a frame of the laser beam printer of the embodiment of FIG. 1.

More specifically, as shown in FIG. 2 which is an enlarged side view of the fixing unit 8, hooks 85 opening toward the photoconductive drum 1 are formed on each side plate 84 of the unit frame 83 of fixing unit 8 at the lower end thereof on the photoconductive drum side. Leg portion 86 of each side plate 84 is bent a predetermined width laterally on the lower end portion thereof except the hooks 85. The leg portions 86 have mounting holes 86A defined at the rear end thereof.

On the other hand, attaching holes 11 are defined on frame 10 at the right and left positions thereof respectively, corresponding to the opposite side plates 84 of fixing unit 8.

Each attaching hole 11 comprises two pass through portions 12, 12, through which hooks 85 can pass upwardly and downwardly, and spaced apart from each other in a forward and backward direction a predetermined distance Δ. Each pass-through portion 12 has locking portion 13 defined at the photoconductive drum 1 side thereof and a communicating portion 14 for communicating pass-through portions 12 along each side thereof.

The communicating portions 14 of the attaching holes 11 at the right and left sides of frame 10, are defined on the same side of each pass-through portion 12. The distance between right and left communicating portions 14 is the same as that between opposite side plates 84 of fixing unit 8.

Further, screw holes 15 are defined in frame 10, spaced apart by the distance "Δ", at the positions which correspond to the mounting holes 86A of leg portions 86 of fixing unit 8 when hooks 85 are locked in locking portions 13 of attaching holes 11.

With the above arrangement, fixing unit 8 is positioned at a predetermined location (location by which the length of the feed path of continuous sheet 20 from transfer unit 7 to fixing unit 8 is set to "S" or "L") in such a manner that fixing unit 8 is located on frame 10, while the hooks 85 are caused to correspond to any of the front and rear sides of pass-through holes 12, and then fixing unit 8 is slidingly moved toward the photoconductive drum 1 to enable the hooks 85 to be locked in locking portions 13. Next, the fixing unit 8 is fixed in this position by tightening screws 88 through screw holes 15 of the frame 10 and mounting holes 86A of leg portions 86.

The location where fixing unit 8 is placed can be changed by loosening the screws and sliding fixing unit 8 is slid backwardly to be unlocked from locking portions 13 (the hooks 85 are located at the pass-through portions 12). Thereafter fixing unit 8 is moved toward the communicating portions 14 to position the hooks 85 therein (as described above, the distance between the right and left communicating portions 14 is the same as that between opposite side plates 84 of unit frame 83). Fixing Unit 8 can then slide forwardly and backwardly in communicating portions 14.

Figure 4:
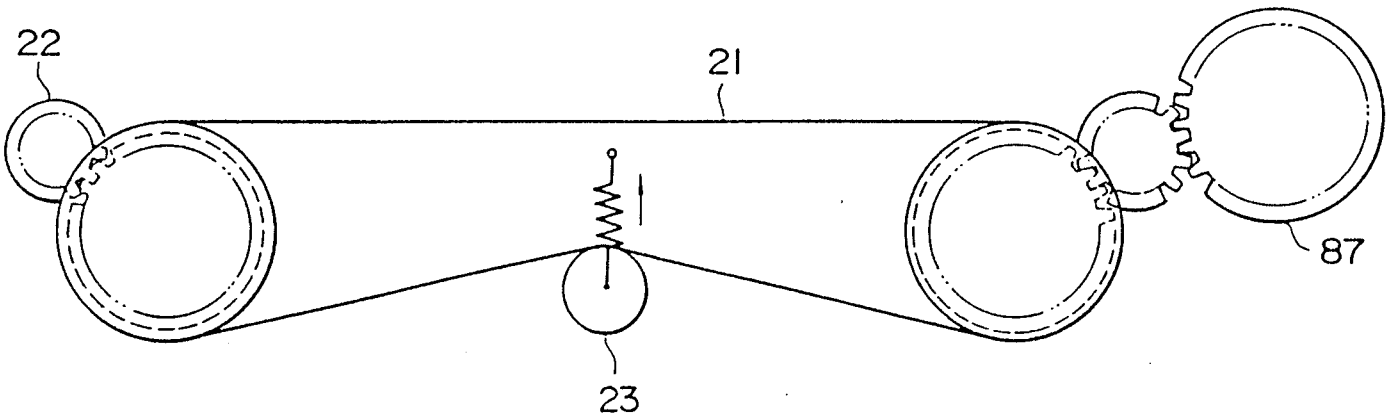
FIG. 4 shows a system for transmitting a driving force to the fixing unit.

Note that although the length of the driving force transmitting path from a drive means to heat roller 81 is changed, as shown in FIG. 4, this is solved in the following manner. The driving force is transmitted through belt 21. An idle roller 23 is pressed against the belt 21 so that the looseness of belt 21 is absorbed, wherein 22 designates a gear driven by the drive means (not shown) and 87 designates a gear fixed to the heat roller 81.

With the above arrangement, the feed paths of the continuous sheet 20 from the transfer unit 7 to the fixing unit 8. "S" and "L", are variable by moving fixing unit 8 to the distances which are substantially the same as those between the perforated tear lines of the continuous sheets 20 which are desired to be used. The location where the fixing unit 8 is placed is selected in accordance with the continuous sheet to be used. Thus a plurality of types of continuous sheets having different distances between the perforated tear lines can be handled used.

For example, when two types of continuous sheets having intervals, of 11 inches and 12 inches between perforated tear lines are to be used, "S" is set to about 11 inches and "L" is set to about 12 inches. In this case $\Delta = 1$ inch.

Note that, in the above embodiment, although fixing unit 8 is arranged such that it can be fixedly disposed at two positions by which a length of the feed path of the continuous sheet 20 is set to "S" and "L", the position at which fixing unit 8 is fixedly disposed is not limited to only two positions, but may be of course, fixed at three or more positions. Thus, the types of usable continuous sheets is increased to make the laser beam printer more dedicated.

In another embodiment, for example, fixing unit 8 may also be suitably arranged in such a manner that guide means (guide rails or guide shafts) are provided with the frame 10 in a direction along which fixing unit 8 is moved and fixing unit 8 is engaged therewith so that it can be slidingly moved, guided by the guide means and fixing unit 8 is moved by a feed screw, cam or the like.

As described above, the electrophotographic printer according to the present invention using a continuous recording sheet enables a plurality of types of continuous sheets having a different interval between perforated tear lines to be used, whereby the printer is made dedicated.

What is claimed is:

1. A printing apparatus employing an electrophotographic system using a continuous recording medium, a toner image being transferred onto said continuous recording medium by transfer means, said printing apparatus comprising:

means for fixing an unfixed toner image on said continuous recording medium, said fixing means being movably disposed in said apparatus; and means for securing said fixing means;

wherein said fixing means is capable of being moved in a direction along which said continuous recording medium is fed and said securing means secures said fixing means at one of a plurality of predetermined positions according to the type of the loaded continuous medium.

2. The printing apparatus according to claim 1, further comprising supporting means adapted to secure said fixing means, said supporting means being provided with at least one slit extending in a direction in which said continuous recording medium is fed; further wherein said fixing means is provided with at least one hook member adapted to slidably engage with said at least one slit, said fixing means being guided along said at least one slit.

3. The printing apparatus according to claim 2, wherein a plurality of positioning openings corresponding to said plurality of predetermined positions are formed on said support means along said at least one slit, said positioning openings adapted to communicate with said at least one slit, said fixing unit being located at said one of a plurality of predetermined positions by engaging said at least one hook member with said positioning openings.

4. The printing apparatus according to claim 3, wherein said securing means further comprises means for fastening said fixing means to said supporting means at said one of a plurality of predetermined positions.

5. The printing apparatus according to claim 4, wherein said supporting means has a plurality of openings corresponding to said plurality of predetermined positions, further wherein said fastening means comprises at least one screw member, said fixing means being fixedly secured at a selected one of said plurality of predetermined positions by engaging said screw member with one of said plurality of openings.

6. The printing apparatus according to claim 1, wherein said continuous recording medium comprises a fan-fold sheet having perforated lines at a predetermined interval in a longitudinal direction, wherein said one of a plurality of predetermined positions is set to correspond to said interval between perforated lines of said fan-fold sheet.

7. The printing apparatus according to claim 1, further comprising means for applying tension arranged between said transfer means and said fixing means adapted to apply tension to said continuous recording medium.

8. The printing apparatus according to claim 7, wherein said continuous recording medium has a plurality of feed holes along opposite lengthwise edges of said continuous recording medium, wherein said tension applying means comprises a belt member having a plurality of projections adapted to be engaged with said plurality of feed holes of said continuous recording medium.

9. The printing apparatus according to claim 8, wherein said tension applying means comprises means for absorbing looseness of said belt member when said fixing means is moved toward said transfer means.

10. The printing apparatus according to claim 1, wherein said securing means secures said fixing means at a certain position in accordance a type of said continuous recording medium used in said printing apparatus.

11. A printing apparatus employing an electrophotographic system using a continuous recording medium, a toner image being transferred onto said continuous medium by transfer means, said printing apparatus comprising:

means for fixing an unfixed toner image on said continuous recording medium, said fixing means being movably disposed in said apparatus; and means for selectively securing said fixing means at at least two predetermined positions.

12. The printing apparatus according to claim 11, wherein said movably disposed fixing means comprises means to accommodate varying sheet lengths of said continuous recording medium.

13. The printing apparatus according to claim 11, further comprising means for supporting said fixing means wherein said fixing means are movably secured to said supporting means.

14. The printing apparatus according to claim 13, wherein said securing means comprises at least one male fitting and at least one female fitting for securing said fixing means to said supporting means.

15. The printing apparatus according to claim 14, wherein said securing means further comprises at least one screw member, said fixing means being fixedly secured at a selected one of said predetermined positions by engaging said screw member with one of a plurality of openings contained in said supporting means.

16. The printing apparatus according to claim 14, wherein at least one of said male and female fittings is provided to correspond to each said predetermined position.

17. The printing apparatus according to claim 14, wherein each said female fitting comprises a slit in said supporting means and each said male fitting comprises a hook member on said fixing means.

18. The printing apparatus according to claim 11, further comprising means for applying tension, arranged between said transfer means and said fixing means, for applying tension to said continuous recording medium.

* * * * *